US008854835B2

(12) United States Patent
Feldstein et al.

(10) Patent No.: US 8,854,835 B2
(45) Date of Patent: Oct. 7, 2014

(54) HI-DEFINITION MULTIMEDIA INTERFACE SHIELD WITH FINGERS

(75) Inventors: Wendy Feldstein, Old Tappan, NJ (US); Gregory Sorrentino, Brewster, NY (US); Esteban Dragonanovic, Nyack, NY (US)

(73) Assignee: Crestron Electronics Inc., Rockleigh, NJ (US)

( * ) Notice: Subject to any disclaimer, the term of this patent is extended or adjusted under 35 U.S.C. 154(b) by 254 days.

(21) Appl. No.: 13/287,202

(22) Filed: Nov. 2, 2011

(65) Prior Publication Data

US 2012/0325547 A1 Dec. 27, 2012

Related U.S. Application Data

(63) Continuation-in-part of application No. 13/195,196, filed on Aug. 1, 2011, now Pat. No. 8,724,343.

(60) Provisional application No. 61/501,421, filed on Jun. 21, 2011.

(51) Int. Cl.
*H01R 13/648* (2006.01)
*H01R 12/72* (2011.01)
*H01R 13/6581* (2011.01)

(52) U.S. Cl.
CPC ..... *H01R 12/724* (2013.01); *H01R 13/6581* (2013.01); *Y10S 439/939* (2013.01)
USPC ..... 361/818; 361/800; 361/816; 174/351; 174/355; 439/607.28; 439/939

(58) Field of Classification Search
CPC ..... H05K 9/0015; H05K 9/0016
USPC ..... 361/818; 439/126, 607.1, 607.12, 439/607.13, 607.15, 607.17, 607.19, 439/607.24, 607.35, 607.47, 607.54; 174/350, 355
See application file for complete search history.

(56) References Cited

U.S. PATENT DOCUMENTS

| | | | | |
|---|---|---|---|---|
| 4,236,779 | A | 12/1980 | Tang | |
| 4,239,318 | A | 12/1980 | Schwartz | |
| 4,386,814 | A * | 6/1983 | Asick | 439/607.28 |
| 4,512,623 | A | 4/1985 | Tomsa | |
| 4,703,133 | A | 10/1987 | Miller | |
| 4,754,101 | A | 6/1988 | Stickney et al. | |
| 5,628,653 | A | 5/1997 | Haas et al. | |
| 6,095,862 | A * | 8/2000 | Doye et al. | 439/607.11 |
| 6,932,640 | B1 | 8/2005 | Sung | |
| 7,270,570 | B1 | 9/2007 | Hamner et al. | |
| 7,473,139 | B2 * | 1/2009 | Barringer et al. | 439/607.17 |
| 7,952,890 | B2 | 5/2011 | Myers et al. | |
| 2006/0036788 | A1 | 2/2006 | Galang et al. | |

* cited by examiner

*Primary Examiner* — Robert J Hoffberg
*Assistant Examiner* — Mukund G Patel
(74) *Attorney, Agent, or Firm* — Crestron Electronics Inc

(57) ABSTRACT

An electromagnetic shield comprises a single sheet of metal having outer and inner peripheries. The outer periphery forms a plurality of outer deflectable fingers extending outward from a bent edge of the outer periphery for contacting a surface of a faceplate. The plurality of outer deflectable fingers is deflectable to allow for installation and removal of the faceplate. The inner periphery has an opening for receiving an HDMI connector and forming a plurality of inner deflectable fingers extending inwardly from a bent edge of the inner periphery. The plurality of inner deflectable fingers is deflectable to allow for insertion and removal of the HDMI connector.

20 Claims, 11 Drawing Sheets

HI-DEFINITION MULTIMEDIA INTERFACE SHIELD WITH FINGERS

BACKGROUND OF THE INVENTION

1. Technical Field

The present invention relates generally to a shielding member. More particularly, the invention relates to an easy to assemble radio frequency and electromagnetic interference shielding member for a Hi-Definition Multimedia Interface (HDMI) connector.

2. Background Art

Electromagnetic interference (EMI) shielded cables and connector assemblies are frequently used for the transmission of data signals between programmable instruments, such as computers and the like, as well as in other environments wherein electrical and electromagnetic radiation can be expected to interfere with the electrical signal carried by the interconnecting cables and connector assemblies. Shielding has been used for years in electrical connectors to keep unwanted radio frequency and electromagnetic signals (RFI/EMI) and electromagnetic pulses (EMP) from interfering with signals being carried by contacts in connectors. Such cables typically use a flexible plastic film that can be trimmed to any desired shape or size as shielding material. A clear liner can be removed to expose adhesive for attachment to a cable connector, such as a Hi-Definition Multimedia Interface (HDMI) connector.

HDMI is a transmission interface developed for next generation multimedia audio/video systems including DVD players, game box converters, TV boxes, etc. The maximum transmission speed of an HDMI interface can be as high as 5 Gb/s. In addition to a video signal, an HDMI interface can simultaneously transmit an 8-channel audio signal. Because HDMI is practical for transmitting digital data without compression, it effectively reduces signal interference and attenuation due to conversion between digital signal and analog signal. An HDMI connector is a small-size connector developed following the step of SATA (Serial AT attachment) interface connector.

Accordingly, it is the object of the present invention to provide an RFI, EMI and/or EMP shield for an HDMI connector.

SUMMARY OF THE INVENTION

It is to be understood that both the general and detailed descriptions that follow are exemplary and explanatory only and are not restrictive of the invention.

DISCLOSURE OF INVENTION

Principles of the invention provide an RFI, EMI and/or EMP shield for an HDMI connector. For example, in a first aspect of the invention, an electromagnetic shield for use on an HDMI connector comprises a single sheet of metal having outer and inner peripheries. The outer periphery forms a plurality of outer deflectable fingers extending outwardly from a bent edge of the outer periphery for contacting a surface of a faceplate. The plurality of outer deflectable fingers is deflectable to allow for installation and removal of the faceplate. The inner periphery has an opening for receiving an HDMI connector and forming a plurality of inner deflectable fingers extending inwardly from a bent edge of the inner periphery. The inner plurality of deflectable fingers is deflectable to allow for insertion and removal of the HDMI connector.

In a second aspect of the invention, an electromagnetic shield for use on an HDMI connector comprises a single sheet of metal having outer and inner peripheries. The outer periphery forms a plurality of outer deflectable fingers extending outwardly from a bent edge of the outer periphery for contacting a surface of a faceplate. The plurality of outer deflectable fingers is deflectable to allow for installation and removal of the faceplate. The inner periphery has an opening for receiving an HDMI connector and forming a plurality of inner deflectable fingers extending inwardly from a bent edge of the inner periphery. The plurality of inner deflectable fingers is deflectable to allow for insertion and removal of the HDMI connector. The outer plurality of deflectable fingers being four outer fingers of the single sheet. The four outer fingers form from top and bottom outer horizontal edges and left and right outer vertical edges. Each of the outer horizontal edges forms at least four fingers of the plurality of outer finger protruding outwardly and each of the outer vertical edge forms at least one finger of the outer plurality of fingers protruding outwardly. The inner plurality of deflectable fingers being four inner fingers of the single sheet, the four inner fingers being formed from top and bottom inner horizontal edges and left and right inner vertical edges. Each of the inner horizontal edges forms at least two fingers of the plurality of inner finger protruding inwardly and each of the inner vertical edge forms at least one finger of the inner plurality of fingers protruding inwardly.

The present invention seeks to overcome or at least ameliorate one or more of several problems, including but not limited to: prevent EMI from interfering with signal being carried by contacts in an HDMI connector.

BRIEF DESCRIPTION OF DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

BRIEF DESCRIPTION OF THE SEVERAL VIEWS OF THE DRAWINGS

Figure 1:
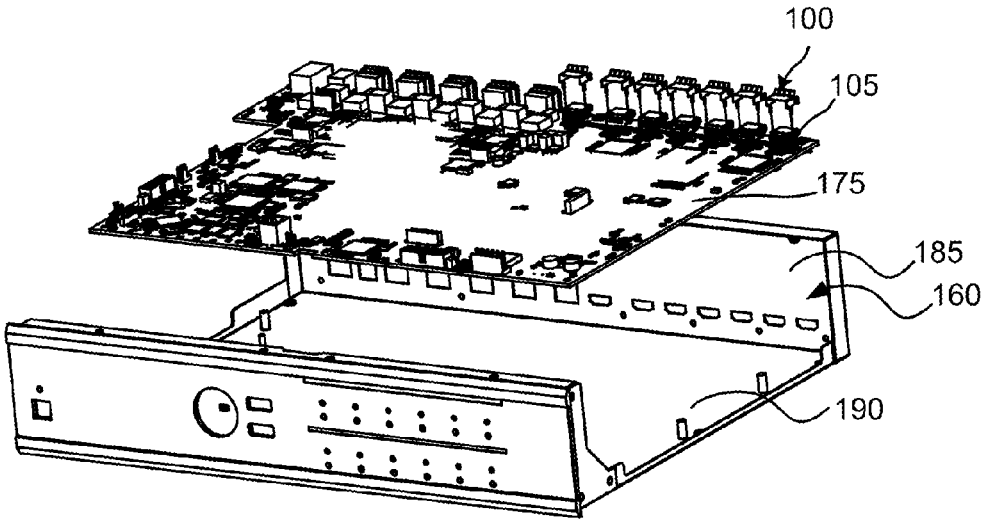
Figure 2:
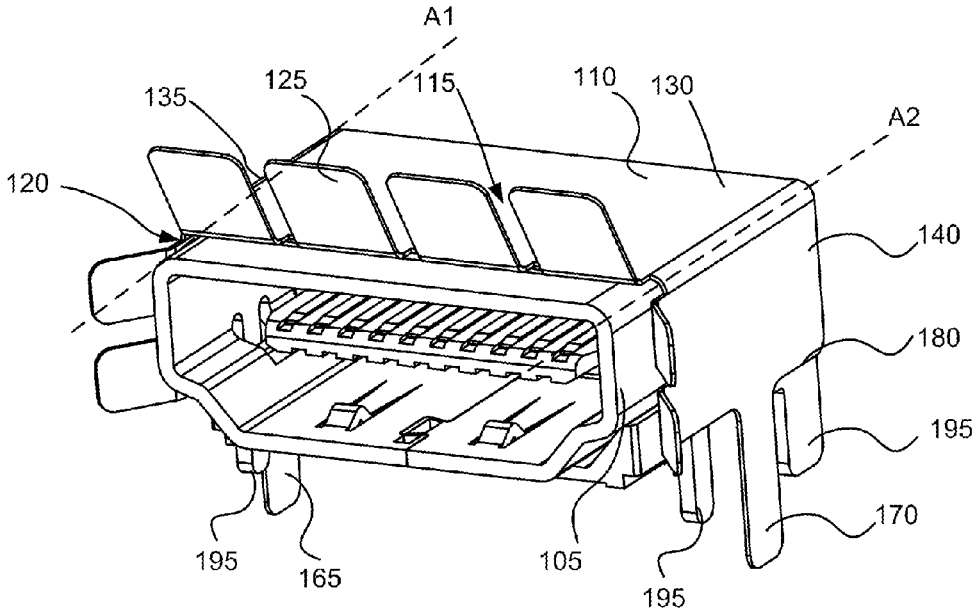

FIG. 1 is an exploded perspective view of an electromagnetic shield for use on an HDMI connector, which is mounted onto a printed circuit board in accordance with an illustrative embodiment of the present invention FIG. 2 is a pictorial view of the electromagnetic shield with the HDMI connector in accordance with an illustrative embodiment of the present invention.

Figure 3:
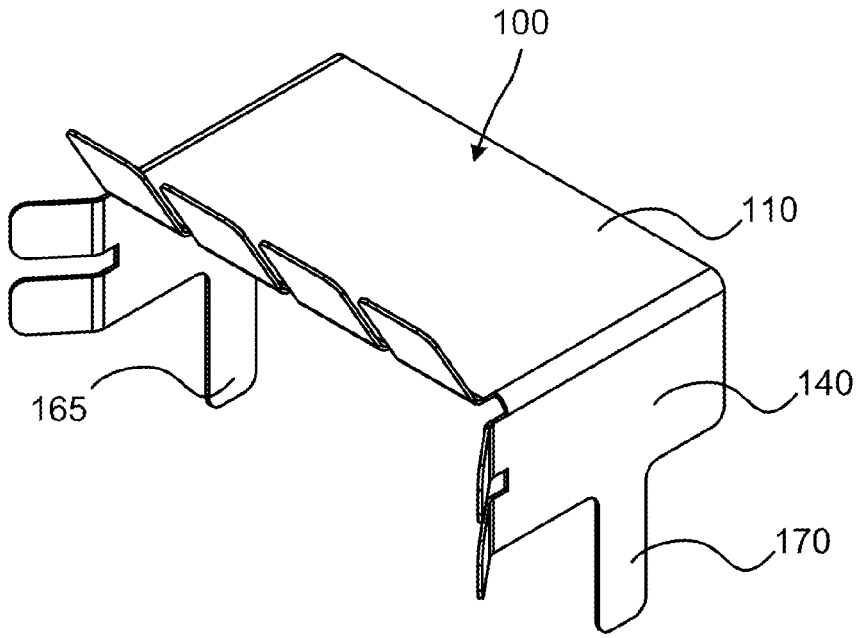

FIG. 3 is a pictorial view of the electromagnetic shield in accordance with an illustrative embodiment of the present invention.

Figure 4:
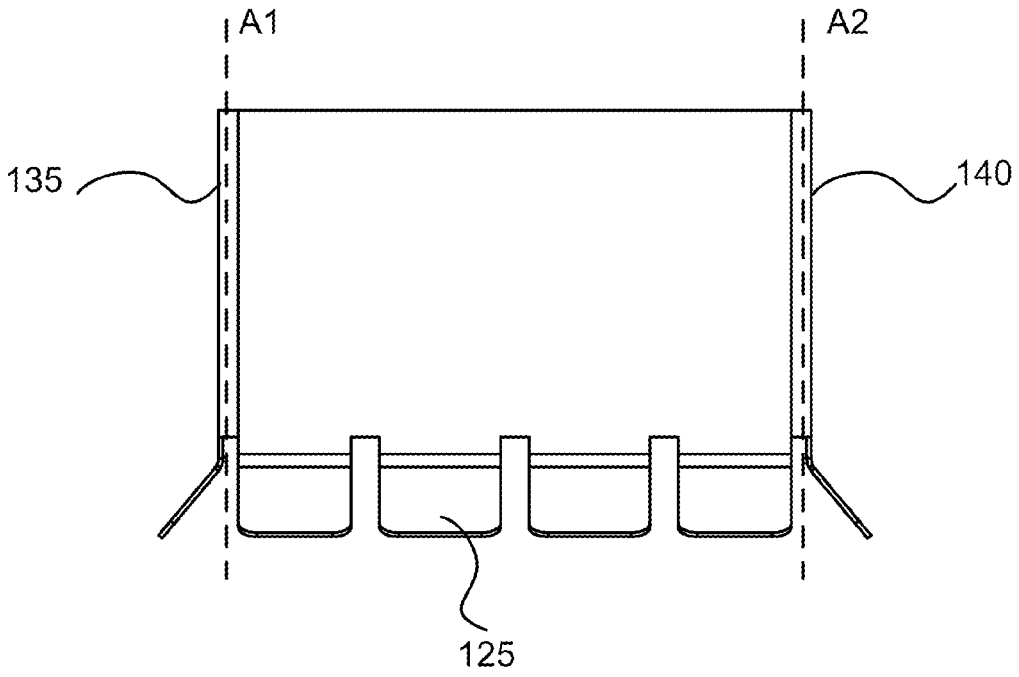

FIG. 4 is a top view of the electromagnetic shield in accordance with an illustrative embodiment of the present invention.

Figure 5:
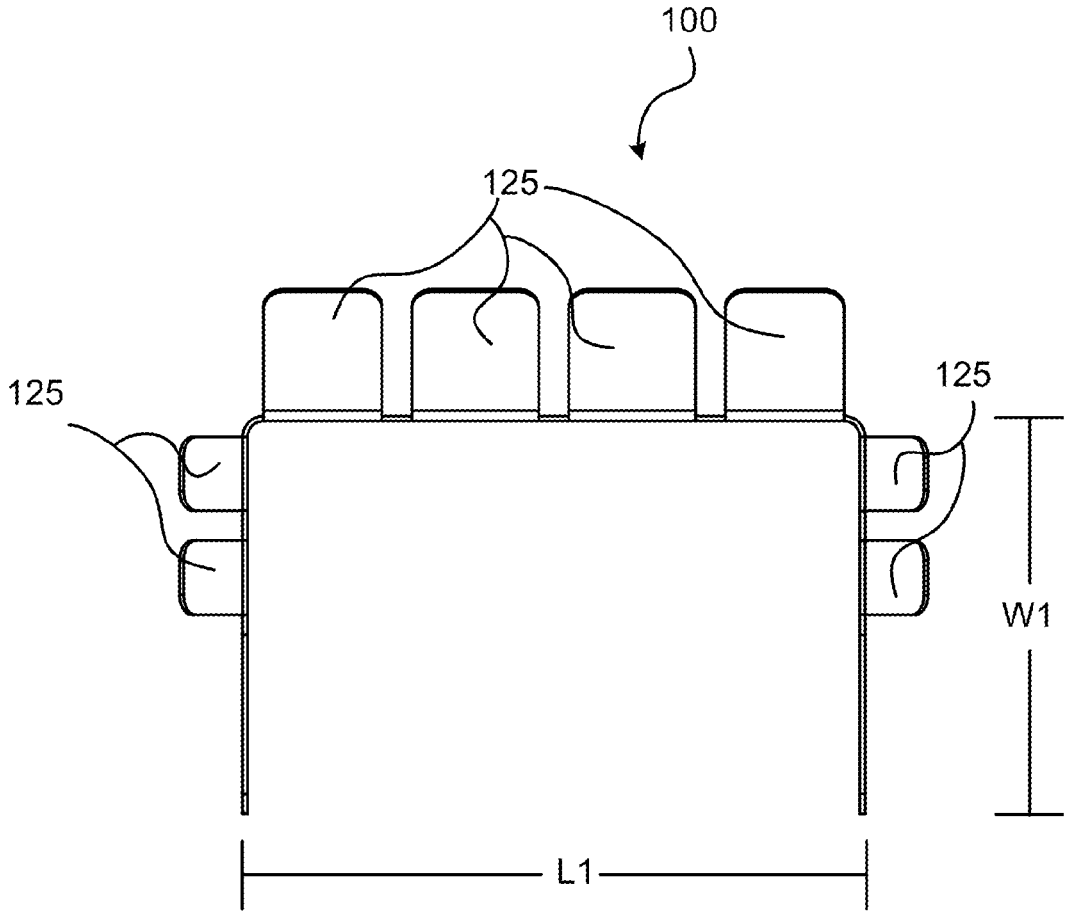

FIG. 5 is a front view of the electromagnetic shield in accordance with an illustrative embodiment of the present invention.

Figure 6:
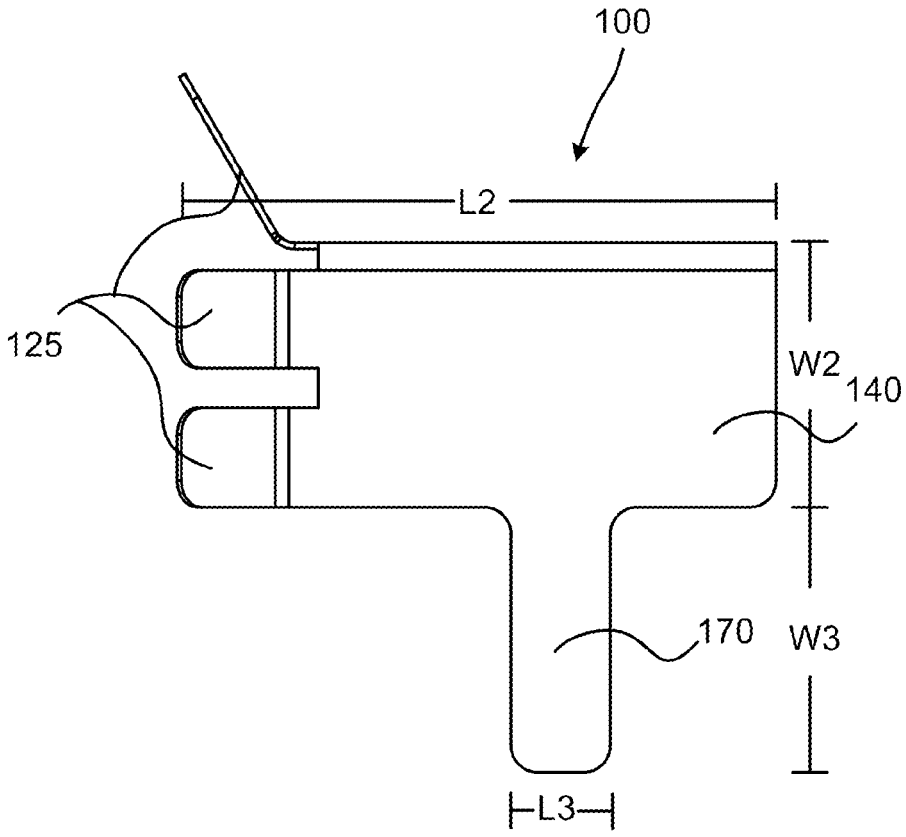

FIG. 6 is a side-view of the electromagnetic shield in accordance with an illustrative embodiment of the present invention.

Figure 7:
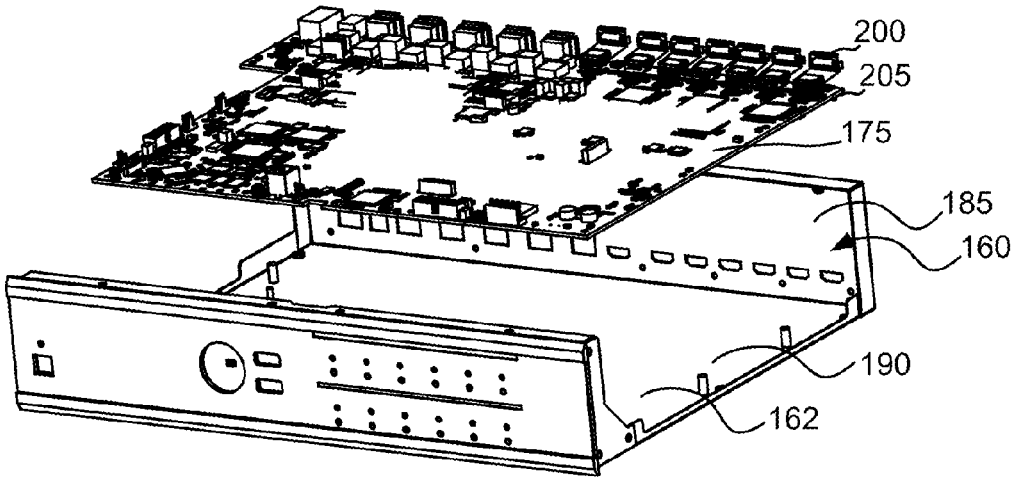

FIG. 7 is an exploded perspective view of another embodiment of an electromagnetic shield for use on an HDMI connector.

Figure 8:
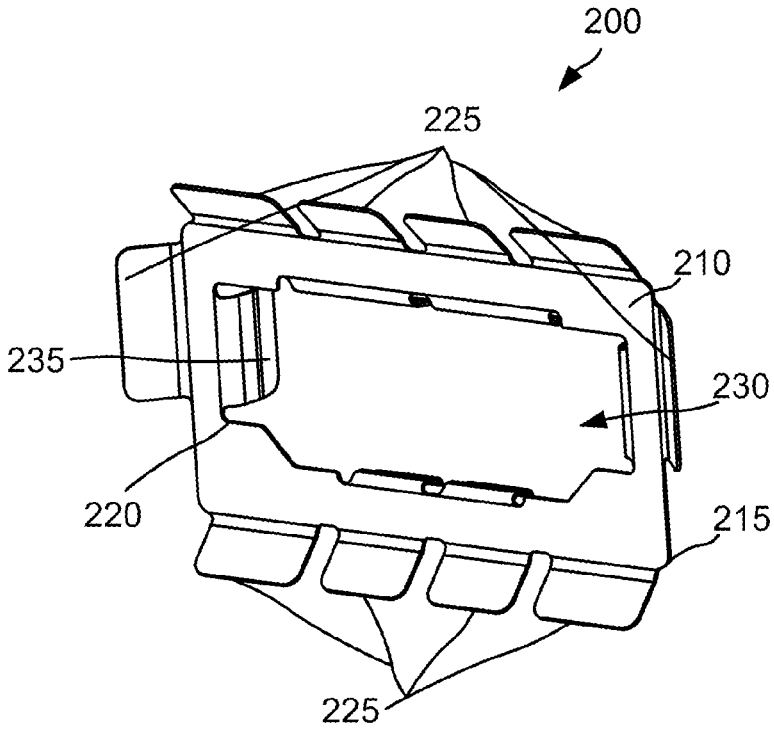

FIG. 8 is a pictorial view of the electromagnetic shield in accordance with another illustrative embodiment of the present invention.

Figure 9:
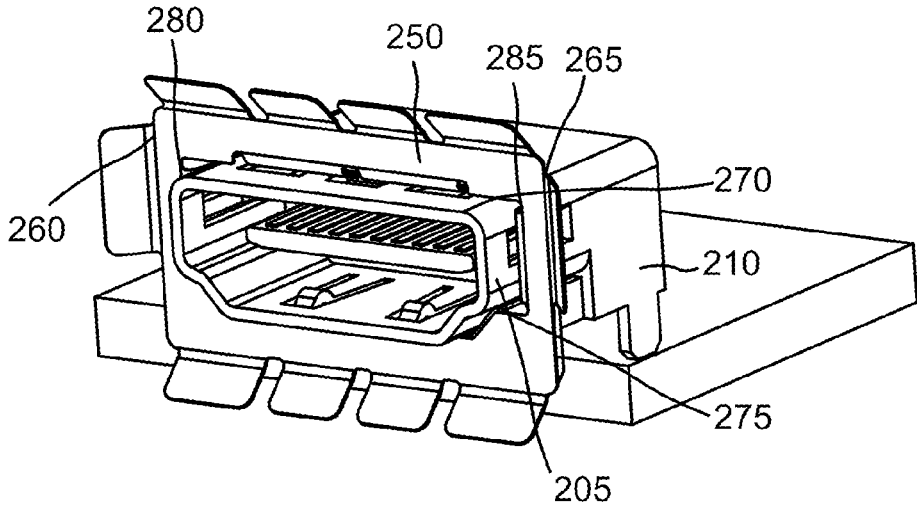

FIG. 9 is a pictorial view of the electromagnetic shield with the HDMI connector in accordance with another illustrative embodiment of the present invention.

Figure 10:
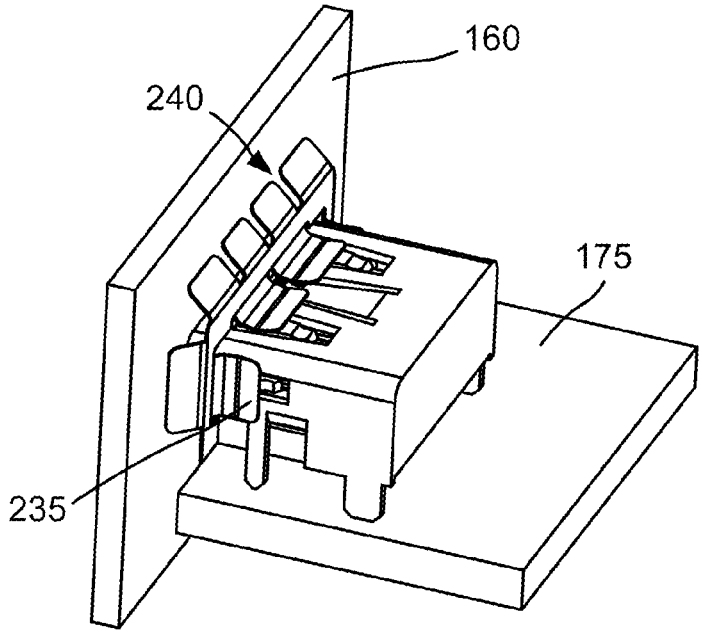

FIG. 10 is a pictorial view of the electromagnetic shield with the HDMI connector and faceplate in accordance with another illustrative embodiment of the present invention.

Figure 11:
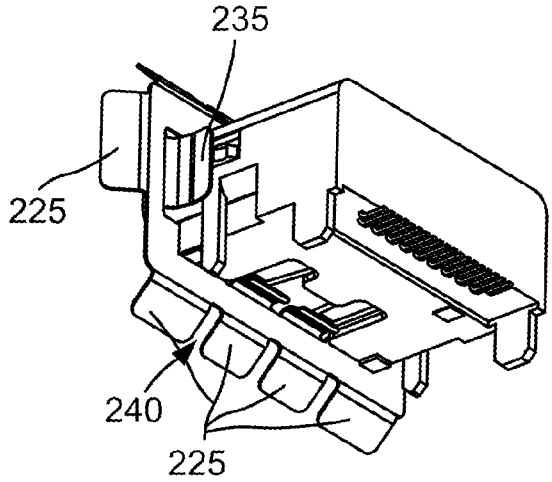

FIG. 11 is a pictorial view of the electromagnetic shield with the HDMI connector in accordance with another illustrative embodiment of the present invention.

Figure 12:
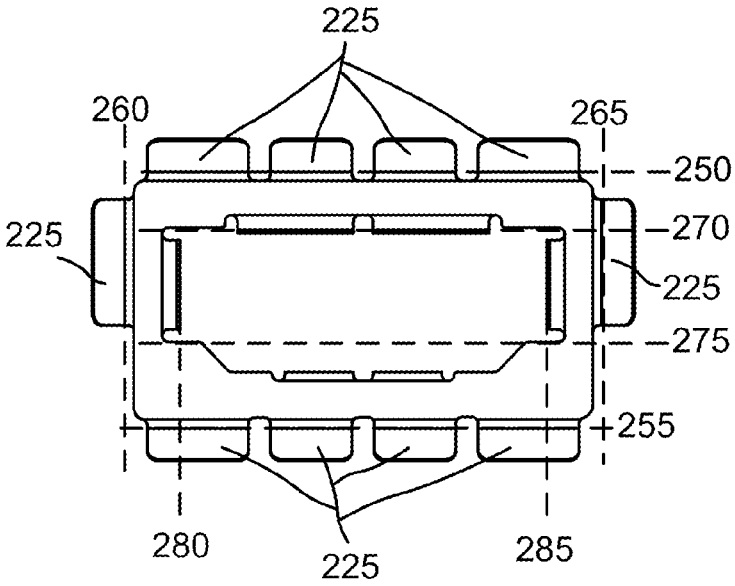

FIG. 12 is a front view of the electromagnetic shield in accordance with another illustrative embodiment of the present invention.

Figure 13:
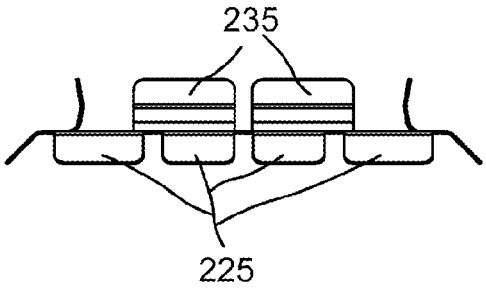

FIG. 13 is a top view of the electromagnetic shield in accordance with another illustrative embodiment of the present invention.

Figure 14:
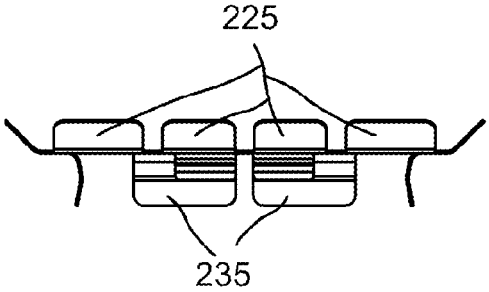

FIG. 14 is a bottom view of the electromagnetic shield in accordance with another illustrative embodiment of the present invention.

Figure 15:
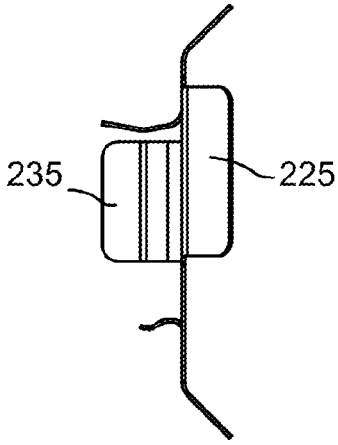

FIG. 15 is a left side view of the electromagnetic shield in accordance with another illustrative embodiment of the present invention.

Figure 16:
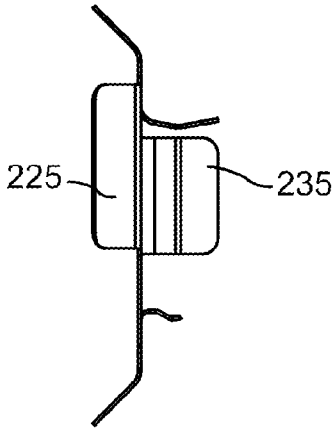

FIG. 16 is a right side view of the electromagnetic shield in accordance with another illustrative embodiment of the present invention.

LIST OF REFERENCE NUMBERS FOR THE MAJOR ELEMENTS IN THE DRAWING

The following is a list of the major elements in the drawings in numerical order.

A1 first bend axis
A2 second bend axis
100, 200 electromagnetic shield
105, 205 HDMI connector
115 slots
120 edge of the sheet
125 fingers
130 top planar surface
135 first side wall
140 second side wall
160 faceplate
162 chassis
165 leg of the first side wall
170 leg of the second side wall
175 printed circuit board
180 bottom edge of each of the first and second side walls
185 surface of a faceplate 160
205 HDMI connector
210 single sheet
215 outer periphery of the single sheet 210
220 inner periphery of the single sheet 210
225 outer plurality of deflectable fingers
230 an opening in the sheet 210
235 inner plurality of deflectable fingers
240 gap
250 top outer horizontal edge
255 bottom outer horizontal edge
260 left outer vertical edge
265 right outer vertical edge
270 top inner horizontal edge
275 bottom inner horizontal edge
280 left inner vertical edge
285 right inner vertical edge

DETAILED DESCRIPTION OF THE INVENTION

Mode(s) for Carrying Out the Invention

The present invention relates to a radio frequency and electromagnetic interference shield for a Hi-Definition Multimedia Interface (HDMI) connector.

FIG. 1 is an exploded perspective view of an illustrative electromagnetic shield 100 with an HDMI connector 105 on an electronic printed circuit board 175 in accordance with one embodiment of the invention. The printed circuit board 175 may be installed onto a chassis 162 having a faceplate 160. The shield 100 makes a ground contact with a surface 185 of the faceplate 160 via the circuit board 175.

Referring to FIG. 2, the shield 100 is formed from a single sheet 110 of metal with an edge 120 bent around the first and second bend axes A1, A2 inwardly and approximately ninety degrees to form a top planar surface 130 and first and second sidewalls 135, 140. To this end, the sheet 110 forms a substantially U-shaped geometry. The sheet 110 includes slots 115 along one of the longitudinal edge 120 of the metal sheet 110 to form a plurality of resilient fingers 125. The fingers 125 are bent outward with a bend radius of approximately 0.020 inches with respect to a flat surface of the first and second sidewalls 135, 140 and top planar surface 130, respectively. The fingers 125 apply a biasing force against the surface 185 of the faceplate 160.

The single sheet 110 of metal is sized and dimensioned to receive the HDMI connector 105 in between the first and second side walls 135, 140 and top planar surface 130. Each of the side walls 135, 140 includes an elongated leg 165, 170 that extends beyond a bottom edge 180 of each of the side walls 135, 140. The shield 100 is operatively coupled to the circuit board 175 to provide an interconnection between the shield 100 and the circuit board 175 such as a ground plane on the board 175. The side walls 135, 140 with the legs 165, 170 are coupled to the circuit board 175 using any suitable approach. For example, the legs 165, 170 may be inserted into holes located on the circuit board 175 and soldered into the circuit board 175, snapped, clipped or mechanically fastened into a structural element of the circuit board 175, or attached using any other suitable approach. In some embodiments, the side walls 135, 140 and top planar surface frame 130 may be separate metal components that are combined into a single piece of shield 100.

Shield 100 may be placed on any suitable portion of the circuit board 175 to surround the HDMI connector 105, which emits electromagnetic radiation or is susceptible to electromagnetic radiation. Once the shield 100 is placed over the HDMI connector 105, the HDMI connector 105 is enclosed by the side walls 135, 140 and top planar cover 130, thus preventing interfering radiation from escaping and damaging the HDMI connector 105 and/or other components. The shield 100 can be installed or removed individually onto/from the circuit board 175 for easy access to the HDMI connector 105 (e.g., for repair) without disturbing the HDMI connector 105 and/or other components that may be sensitive to interferences. The HDMI connector 105 may have four legs 195 that are inserted into holes created on the circuit board to provide a ground terminal connection.

Once the HDMI connector 105 is installed onto the circuit board 175 with the faceplate 160 (FIG. 1), at least a portion of the fingers 125 flex and make contact with the faceplate 160 for a ground connection. Advantageously, the resilient fingers 125 apply a biasing force against the surface 185 (FIG. 1) of the faceplate 160 for the ground connection. The fingers 125 may be flexibly biased towards the surface 185 of the faceplate 160 such that the fingers 125 may deflect when they are placed against the surface 185 of the faceplate 160, thus creating tension onto the surface 185. If the fingers 125 are removed from installation, the finger 125 may bend back to its normal or non-tensed position or may take a minimal set but will remain functional. In other words, the fingers 125 maintain the same bent radius even after being bent to another radius when the shield 100 is installed. This allows the shield 100 to be re-usable instead of being a one-time use component. Further, since the shield 100 is installed onto the HDMI connector 105 separately, the shield 100 can be sold as an off the shelf product without the HDMI connector 100. Moreover, if the HDMI connector is damaged, the reusable shield 100 can be reinstalled onto another HDMI connector without having to throw away a shield that is integrated with an HDMI connector. This saves raw material cost by not wasting an otherwise functional shield just because of a bad connector.

The shield 100 may be coupled to the HDMI connector 105 and circuit board 175 using any suitable approach. In one embodiment, the legs 165, 170 may be soldered to the circuit board 175. In other embodiments, once the connector 105 is soldered onto the circuit board 175, the shield 100 may include snaps (not shown) to engage a portion of the side walls of the connector 105. Snaps may include one or more mechanisms for engaging the side walls of the connector. For example, snaps may be elastically biased towards the side walls of the connector 105 such that the snaps may deflect when they are placed over the connector 105, thus creating an interference or frictional fit. As another example, snaps may include a tab or protrusion, operative to engage a corresponding indentation or tab, respectively, in the side walls of the connector 105. As still another example, a tape, adhesive or mechanical fastener (e.g., a screw may pass through the snaps and engage the side walls of the connector 105 and/or circuit board 175.

Each shield 100 may include any suitable number of fingers 125 with slots 115 equally spaced in-between each finger 125. Referring to FIGS. 3-6, in one embodiment, there are four fingers 125 extending from the top planar surface 130 and two fingers 125 extending from each side walls 135, 140. The fingers 125 on the top planar surface 130 may have longer lengths and widths than the fingers 125 of the side walls 135, 140. The amount of contacts the fingers 125 can make with the surface 185 of the faceplate 160 depends on the placement of the shield 100 onto the connector 105.

Each of the plurality of resilient fingers 125 is independently flexible, and thus can accommodate non-uniform thicknesses of the surface 185 of the faceplate 160. Some faceplates may have uneven surfaces and therefore the shield 100 can accommodate such uneven surfaces. Each of the plurality of resilient fingers 125 is able to transition between a non-flexed state and a flexed state. The flexed state is when the finger 125 biases the surface 185 of the faceplate 160 and the non-flexed state is when the finger 125 does not apply a force onto the surface 185.

Before fixedly coupling the shield 100 over the connector to the circuit board 175, the connector 105 with the fingers 125 slides away or towards the surface 185 of the faceplate 160 so as to vary the amount of force the fingers apply to the surface 185. This enables the shield 100 to accommodate varying faceplate 160 thicknesses while the fingers 125 maintain contact with the surface 185 of the faceplate 160.

The shield 100 may be manufactured from any suitable material operative to shield the connector 105 and/or other components from electromagnetic interference (e.g., from other components of the electronic device). In one embodiment, shield 100 may be constructed from Beryllium Copper alloy and plated with tin. In other embodiments, the shield 100 may be constructed from an electrically conductive material such as, for example, metal (e.g., Copper, Silver, Aluminum, Steel), graphite, plasma, or any other conductive material.

The dimensions of the metal sheet 110 varies depending on the application; however, in one embodiment, the sheet 110 is sized and dimensioned to receive the HDMI connector 105 in between the first and second side walls 135, 140 and top planar surface 130. The sheet 110 has approximately a uniform thickness of 0.005 inches. The length (shown as "L1" in FIG. 5) and width (shown as "W1" in FIG. 5) of the top planar surface are approximately 0.625 inches and 0.400 inches, respectively. Each of the side walls 135, 140 has a length (shown as "L2" in FIG. 6) and width (shown as "W2" in FIG. 6) are approximately 0.450 inches and 0.200 inches, respectively. Each of the legs has a length (shown as "L3" in FIG. 6) and width (shown as "W3" in FIG. 6) is approximately 0.075 inches and 0.200, respectively. Other dimensions of the metal sheet 110 may vary depending on the application and size of the connector.

FIG. 7 is another embodiment of an electromagnetic shield 200 for use on an HDMI connector 205. The printed circuit board 175 may be installed onto a chassis 162 having a faceplate 160. The faceplate 160 is coupled to the chassis 162 using screws or other well known mechanical fasteners. The shield 200 makes a ground contact with a surface 185 of the faceplate 160.

Referring to FIGS. 8 and 9, the electromagnetic shield 200 for use on an HDMI connector 205 comprises a single sheet 210 of metal. The single sheet 210 of metal may be stamped to 0.004 inch thick Beryllium Copper alloy. The sheet 210 may be finished with bright tin plate. Preferably, the tin plated Beryllium Copper alloy has a tin plating layer uniform thickness of approximately 0.0002-0.0005 inch. However, other dimensions including the thickness may vary. Other methods of forming and finishing may be used, and other materials including other metals and alloys of copper may be used. However, it is desirable to use a material having sufficient resiliency so as to provide a desired level of flexibility in the fingers 225, 235 as discussed herein. It is also desirable to use a material that has sufficient electrical conductivity for electrical grounding. However the shield 200 should reduce magnetic field interference.

The single sheet 210 includes an opening 230 that is sized and dimensioned for receiving the HDMI connector 205. In operation, an assembler may insert the shield 200 onto the HDMI connector 205 via the opening 230. The assembler also may easily remove the shield 200 from the HDMI connector 205 by pulling the shield 200 away from the HDMI connector 205. It is advantageous that the shield 200 may be inserted on or removed from the HDMI connector 205 because this means that the HDMI connector 205 does not have to be purchased from a supplier that integrates the shield 200 onto the HDMI connector 205. Further, if the HDMI connector 205 is damaged, the reusable shield 200 can be reinstalled onto another HDMI connector without having to throw away a shield that is integrated with an HDMI connector. This saves raw material cost by not wasting an otherwise functional shield just because of a bad connector.

Continuing on to FIGS. 8 and 9, the single sheet 210 of metal has outer and inner peripheries 215, 220. The outer periphery 220 forms a plurality of outer deflectable fingers 225 extending outwardly from a bent edge of the outer periphery 220 for contacting a surface 185 of a faceplate 160.

Preferably, the outer deflectable fingers 225 extend about 0.022 inch from the bent edge of the outer periphery 220 and have bend radii of 0.020 inch. The plurality of outer deflectable fingers 225 are deflectable to allow for installation and removal of the faceplate 160.

The inner periphery 220 includes the opening 230 for receiving the HDMI connector 205 and forming a plurality of inner deflectable fingers 235 extending inward from a bent edge of the inner periphery 220. The plurality of inner deflectable fingers 225 are deflectable to allow for insertion and removal of the HDMI connector 205. As the connector 205 pushes through the opening/cutout 230 in the faceplate 160, the plurality of outer fingers 225 compress against the surface 185. Upon installation of the shield 200 onto the HDMI connector 205, the outer and inner plurality of resilient fingers 225, 235 make contact with the surface 185 of the faceplate 160 and the HDMI shield 205, respectively, to provide ground contacts. In one embodiment, the outer and inner plurality of fingers 225, 235 have greater deflectability than the surface 185 of the faceplate 160 and the walls of the HDMI connector 205, respectively. Further, each of the outer and inner plurality of fingers 225, 235 is deflectable independently. Each of the outer and inner plurality of fingers 225, 235 is able to transition between a non-flexed state and a flexed state. The flexed state is when the finger 225, 235 biases the surfaces of the faceplate 160 or the HDMI connector 205 and the non-flexed state is when the finger 225, 235 has no force being applied to the finger 225, 235.

Referring to FIGS. 10-16, in an embodiment of the present disclosure, the plurality of outer deflectable finger 225 includes four outer fingers protruding outwardly on each of the top and bottom outer horizontal edges 250, 255. The plurality of outer deflectable fingers 225 further includes one outer finger 225 protruding outwardly on each of the left and right outer vertical edges 260, 265.

The inner plurality of deflectable fingers 235 forms two inner fingers 235 protruding inwardly from each of the top and bottom inner horizontal edges 270, 275 and one inner finger protruding inwardly from the left and right inner vertical edges 280, 285. In-between each finger 225, 235 is a gap 240 of approximately 0.035 inch wide, 0.080 inch in length, and 0.165 apart on centers. The gaps 240 may be regularly spaced between each of the outer and inner plurality of fingers 225, 235 for increasing the deflectability of the outer and inner plurality of fingers 225, 235. The spacing, width, and length of the gap determine the dimensions of the fingers 225, 235, which affects the deflectability of the fingers 225, 235 to work independently of each other to provide individual and continuous contact with the surface of the faceplate 160, even if the surface is irregular and not smooth. It is preferably for the fingers 225, 235 to have a higher deflectability than the surface of the faceplate 160 and the walls of the HDMI connector 205, respectively because this allows the fingers 225, 235 to maintain good electrical and physical contact with the surface of the faceplate 160 and the walls of the HDMI connector 205.

INDUSTRIAL APPLICABILITY

To solve the aforementioned problems, the present invention is a unique device for shielding radio frequency and EMI on an electronic device.

LIST OF ACRONYMS USED IN THE DETAILED DESCRIPTION OF THE INVENTION

The following is a list of the acronyms used in the specification in alphabetical order.

| | |
|---|---|
| HDMI | High-Definition Multimedia Interface |
| EMI | Electromagnetic interference |
| RF | Radio Frequency |
| EMP | Electromagnetic pulses |
| SATA | Serial AT attachment |

ALTERNATE EMBODIMENTS

Although illustrative embodiments of the present invention have been described herein with reference to the accompanying drawings, it is to be understood that the invention is not limited to those precise embodiments, and that various other changes and modifications may be made therein by one skilled in the art without departing from the scope of the appended claims.

What is claimed is:

1. An electromagnetic shield for use on an HDMI connector, comprising:

a single sheet of substantially planar metal having outer and inner peripheries and a substantially planar surface, wherein the outer periphery form a plurality of outer deflectable fingers extending outwardly from a bent edge of the outer periphery for contacting a surface of a faceplate, the plurality of outer deflectable fingers being deflectable to allow for installation and removal of the faceplate, wherein the inner periphery have an opening sized to receive an HDMI connector and forming a plurality of inner deflectable fingers along the entire inner periphery and extending inwardly from a bent edge of the inner periphery, the plurality of inner deflectable fingers being deflectable to allow for insertion and removal of the HDMI connector;

wherein said outwardly extending fingers extend from a first side of a plane formed by said substantially planar surface of said electromagnetic shield, and wherein said inwardly extending fingers extend from a second side of said plane, opposite to said first side of said plane.

2. The shield of claim 1, wherein the outer and inner plurality of fingers have greater deflectability than the surface of the faceplate and the walls of the HDMI connector, respectively.

3. The shield of claim 1, wherein the outer and inner plurality of fingers apply a biasing force against the surface of the faceplate and the surface of the HDMI shield.

4. The shield of claim 1, wherein the single sheet of metal is composed of Beryllium Copper alloy.

5. The shield of claim 4, wherein the Beryllium Copper alloy single sheet is plated with tin.

6. The shield of claim 5, wherein the single sheet of metal with the tin plated Beryllium Copper alloy has a uniform tin plating layer thickness of approximately 0.0002-0.0005 inches.

7. The shield of claim 1, wherein the outer and inner plurality of resilient fingers make contact with the surface of the faceplate and the HDMI shield, respectively, to provide ground contacts.

8. The shield of claim 1, wherein each of the outer and inner plurality of fingers is deflectable independently.

9. The shield of claim 1, wherein each of the outer and inner plurality of fingers is able to transition between a non-flexed state and a flexed state, wherein the flexed state is when the finger biases the surfaces of the faceplate or the HDMI shield and the non-flexed state is when the finger has no force being applied to the finger.

10. The shield of claim 1, further comprising at least one gap in-between each of the outer and inner plurality of fingers.

11. The shield of claim 1, further comprising regularly spaced gaps between each of the outer and inner plurality of fingers for increasing the deflectability of the outer and inner plurality of fingers.

12. The shield of claim 1, wherein the outer and inner plurality of fingers have a substantially rectangular shape.

13. The shield of claim 1, wherein the outer plurality of deflectable fingers are four outer fingers of the single sheet, the four outer fingers being formed from top and bottom outer horizontal edges and left and right outer vertical edges.

14. The shield of claim 13, wherein each of the outer horizontal edges forms at least four fingers of the plurality of outer finger protruding outwardly and each of the outer vertical edge forms at least one finger of the outer plurality of fingers protruding outwardly.

15. The shield of claim 1, wherein the inner plurality of deflectable fingers are four inner fingers of the single sheet, the four inner fingers being formed from top and bottom inner horizontal edges and left and right inner vertical.

16. The shield of claim 15, wherein each of the inner horizontal edges forms at least two fingers of the plurality of inner finger protruding inwardly and each of the inner vertical edge forms at least one finger of the inner plurality of fingers protruding inwardly.

17. The shield of claim 1, wherein the faceplate is coupled to a chassis at approximately ninety degree angle.

18. An electromagnetic shield for use on an HDMI connector, comprising:

a single sheet of substantially planar metal having outer and inner peripheries and a substantially planar surface, wherein the outer periphery forms a plurality of outer deflectable fingers extending outwardly from a bent edge of the outer periphery for contacting a surface of a faceplate, the plurality of outer deflectable fingers being deflectable to allow for installation and removal of the faceplate, wherein the inner periphery have an opening sized to receive an HDMI connector and forming a plurality of inner deflectable fingers along the entire inner periphery and extending inwardly from a bent edge of the inner periphery, the plurality of inner deflectable fingers being deflectable to allow for insertion and removal of the HDMI connector, wherein the outer plurality of deflectable fingers are four outer fingers of the single sheet, the four outer fingers being formed from top and bottom outer horizontal edges and left and right outer vertical edges, wherein each of the outer horizontal edges forms at least four fingers of the plurality of outer finger protruding outwardly and each of the outer vertical edge forms at least one finger of the outer plurality of fingers protruding outwardly, wherein the inner plurality of deflectable fingers are four inner fingers of the single sheet, the four inner fingers being formed from top and bottom inner horizontal edges and left and right inner vertical edges, wherein each of the inner horizontal edges forms at least two fingers of the plurality of inner finger protruding inwardly and each of the inner vertical edge forms at least one finger of the inner plurality of fingers protruding inwardly; and wherein said outwardly extending fingers extend from a first side of a plane formed by said substantially planar surface of said electromagnetic shield, and wherein said inwardly extending fingers extend from a second side of said plane, opposite to said first side of said plane.

19. The shield of claim 18, wherein the outer and inner plurality of fingers have greater deflectability than the surface of the faceplate and the walls of the HDMI connector, respectively.

20. The shield of claim 18, further comprising at least one gap in-between each of the outer and inner plurality of fingers.

* * * * *